US012234632B2

(12) United States Patent
Lin et al.

(10) Patent No.: US 12,234,632 B2
(45) Date of Patent: Feb. 25, 2025

(54) FOAMING DEVICE AND FOAMING TOILET

(71) Applicant: Komoo Intelligent Technology Co., Ltd., Fujian (CN)

(72) Inventors: Xiaofa Lin, Fujian (CN); Xiaoshan Lin, Fujian (CN); Zuhua Liu, Fujian (CN); Shan Lin, Fujian (CN); Yanxin Xu, Fujian (CN)

(73) Assignee: Komoo Intelligent Technology Co., Ltd., Fujian (CN)

( * ) Notice: Subject to any disclaimer, the term of this patent is extended or adjusted under 35 U.S.C. 154(b) by 234 days.

(21) Appl. No.: 18/074,547

(22) Filed: Dec. 5, 2022

(65) Prior Publication Data

US 2023/0097141 A1 Mar. 30, 2023

Related U.S. Application Data

(63) Continuation of application No. PCT/CN2020/110378, filed on Aug. 21, 2020.

(30) Foreign Application Priority Data

Jun. 5, 2020 (CN) ..... 202010505693.5

(51) Int. Cl.
*E03D 9/00* (2006.01)

(52) U.S. Cl.
CPC ..... *E03D 9/005* (2013.01)

(58) Field of Classification Search
CPC ..... E03D 9/005; E03D 9/02; E03D 2009/028; B01F 5/0405; B01F 5/043; B01F 5/04; B01F 2215/008
See application file for complete search history.

(56) References Cited

U.S. PATENT DOCUMENTS 7,316,038 B2 * 1/2008 Egeresi ..... E03D 9/005 4/223
2015/0101113 A1 4/2015 Lee et al.
2020/0095755 A1 * 3/2020 Tran ..... E03D 9/005

FOREIGN PATENT DOCUMENTS

CN 106894484 A 6/2017
CN 206220210 U 6/2017
CN 107923168 A 4/2018
(Continued)

OTHER PUBLICATIONS

International Search Report and English Translation cited in PCT/CN2020/110378, mailed Mar. 4, 2021, 7 pages.
(Continued)

*Primary Examiner* — Erin Deery
(74) *Attorney, Agent, or Firm* — Cooper Legal Group, LLC

(57) ABSTRACT

A foaming device comprises a valve body, a pump, and a self-suction spray head. The valve body comprises a water inlet port, a liquid inlet port, a mixing cavity, and a liquid outlet port. Each of the water inlet port, the liquid inlet port, and the liquid outlet port is in communication with the mixing cavity, and an input end of the pump is connected to the liquid outlet port to enable the mixing cavity to generate a negative pressure to suck water and foaming agent respectively from the water inlet port and the liquid inlet port for mixing. The self-suction spray head is connected to an output end of the pump, and the self-suction spray head comprises a first air inlet hole and a spray hole to enable mixed liquid to be mixed with air to produce foam to be sprayed out.

20 Claims, 7 Drawing Sheets

(56) References Cited

FOREIGN PATENT DOCUMENTS

| | | | | | |
|---|---|---|---|---|---|
| CN | 109778973 | A | | 5/2019 | |
| CN | 210151855 | U | | 3/2020 | |
| CN | 111622317 | A | | 9/2020 | |
| JP | H08302796 | A | | 11/1996 | |
| JP | 2004100331 | A | | 4/2004 | |
| JP | 2008138420 | A | | 6/2008 | |
| JP | 2015183390 | A | | 10/2015 | |
| JP | 5906437 | B2 | | 4/2016 | |
| JP | 2017048570 | A | | 3/2017 | |
| JP | 2017227084 | A | | 12/2017 | |
| WO | WO-2013147408 | A1 | * | 10/2013 | ..... E03D 11/00 |

OTHER PUBLICATIONS

Decision to Grant a Patent in corresponding JP Patent Application 2022-574764, mailed Jan. 18, 2024, 5 pages.

* cited by examiner

FOAMING DEVICE AND FOAMING TOILET

RELATED APPLICATIONS

This application is a continuation of and claims priority to PCT patent application number PCT/CN2020/110378, filed Aug. 21, 2020, which claims priority to Chinese patent application number 202010505693.5, filed on Jun. 5, 2020. PCT patent application number PCT/CN2020/110378 and Chinese patent application number 202010505693.5 are incorporated herein by reference.

FIELD OF THE DISCLOSURE

The present disclosure relates to the field of sanitary ware, and in particular to a foaming device and a foaming toilet.

BACKGROUND OF THE DISCLOSURE

At present, an intelligent toilet has many functions such as warm water flushing, warm air drying, seat heating, etc. However, in actual use, a dropping of excrement will splash liquid in the toilet and cause body pollution. At the same time, the excrement will be in a state of natural exposure before being washed away, and the odor is easily emitted and is difficult to remove, which brings inconvenience to people when going to the toilet. Therefore, a foaming toilet appears on the market, and foam generated by a foam generating device covers the toilet bowl, which effectively solves the problem of dirt on the toilet.

At present, a foaming structure on the intelligent toilet on the market is configured to produce foam by mixing foaming agent and water using a foaming stone connected with an air pump, and the foaming structure comprises a water tank, a liquid storage tank, a water pump, a liquid pump, the air pump, etc. The structure is complicated, the volume is large, and the connection structure and the structure that achieves the function of foaming are complicated and inefficient. At the same time, the connection structure and the structure that achieves the function of foaming takes up too much internal space of the intelligent toilet, so that the intelligent toilet with foaming function is huge. In addition, in addition to low foaming efficiency and complex structure, the cost is also high.

BRIEF SUMMARY OF THE DISCLOSURE

The present disclosure provides a foaming device and a foaming toilet with simple structure, convenient installation, and low cost to solve the deficiencies in the background.

Technical solutions of the present disclosure are as follows.

A foaming device comprises a valve body, a pump, and a self-suction spray head. The valve body comprises a water inlet port, a liquid inlet port, a mixing cavity, and a liquid outlet port. Each of the water inlet port, the liquid inlet port, and the liquid outlet port is in communication with the mixing cavity, and an input end of the pump is connected to the liquid outlet port to enable the mixing cavity to generate a negative pressure to suck water and foaming agent respectively from the water inlet port and the liquid inlet port for mixing. The self-suction spray head is connected to an output end of the pump, and the self-suction spray head comprises a first air inlet hole and a spray hole to enable mixed liquid to be mixed with air to produce foam to be sprayed out.

A foaming device comprises a valve body, two pumps, and a self-suction spray head. The valve body comprises a water inlet port, a liquid inlet port, a mixing cavity, and a liquid outlet port. Each of the water inlet port, the liquid inlet port, and the liquid outlet port is in communication with the mixing cavity. A first one of the two pumps is connected to the water inlet port to suck water into the mixing cavity, and a second one of the two pumps is connected to the liquid inlet port to suck foaming agent into the mixing cavity. The self-suction spray head is connected to the liquid outlet port and comprises a first air inlet hole and a spray hole to enable mixed liquid to be mixed with air to produce foam to be sprayed out.

Preferably, the mixing cavity comprises at least two cavities located therein, and the at least two cavities are sequentially connected together to form a mixing channel.

Preferably, at least one partition is disposed in the mixing cavity, and a gap is defined between a top, a bottom, a front side, or a rear side of the at least one partition and a corresponding side wall of the mixing cavity.

Preferably, an inner diameter of the water inlet port is larger than an inner diameter of the liquid inlet port.

Preferably, the self-suction spray head comprises a foaming cavity and an accelerating hole. The foaming cavity is in communication with each of the first air inlet hole and the spray hole, and the accelerating hole is in communication with the foaming cavity.

Preferably, the self-suction spray head comprises a self-suction head and a spray head, the self-suction head comprises the first air inlet hole, and the spray head is in communication with the self-suction head and comprises the spray hole.

Preferably, a mesh is disposed at the spray hole.

Preferably, the foaming device further comprises a spray tube, a first end of the spray tube is in communication with the self-suction spray head, and a second end of the spray tube comprises a spray port Preferably, the spray tube comprises a first suction part and a second suction part. A first end of the first suction part is connected to the self-suction spray head and comprises a plurality of second air inlet holes, and the second suction part is arranged obliquely at a second end of the first suction part and comprises a third air inlet hole.

A foaming toilet comprises a toilet body, a water tank, and an agent tank. The foaming toilet further comprises the foaming device, the water tank is connected to the water inlet port, and the agent tank is connected to the liquid inlet port.

Preferably, the foaming toilet further comprises a mounting groove arranged on the toilet body and comprising an inclined surface portion inclined toward a toilet bowl, and the self-suction spray head is located in the mounting groove and the spray hole faces or faces away the inclined surface portion.

Compared with the existing techniques, the technical solution has the following advantages.

1. The foaming device of the present disclosure is disposed on the toilet and comprises a pump and a self-suction spray head. The mixing cavity generates a negative pressure through work of the pump, and the water and foaming agent are sucked in through the water inlet port and the liquid inlet port respectively for mixing. Cooperating with the first air inlet hole and the spray hole of the self-suction spray head, the mixed liquid and the air are mixed with each other to form the foam to be sprayed out. The structure is simple, small in size, convenient to install, low in cost, and high foaming efficiency.

2. The foaming device of the present disclosure is disposed on the toilet and comprises two pumps and a self-suction spray head. The two pumps works to suck in the water and the foaming agent for mixing, and the two pumps cooperate with the first air inlet hole and the spray hole of the self-suction spray head to mix the mixed liquid with the air to form the foam to be sprayed out, which has a simple structure, a small size, convenient installation, low cost, and high foaming efficiency. The two pumps can accurately control the output quantitatively and regularly. After mixing, the two pumps can also control the water to continue to enter the mixing cavity to push the mixed liquid out of the mixing cavity.

3. The foaming device of the present disclosure makes the mixing cavity be divided into at least two cavities by at least one partition, which further constitutes a mixing channel, so that the foaming agent and the water are mixed more evenly.

4. The foaming device of the present disclosure comprises the valve body having the water inlet port whose inner diameter is larger than the inner diameter of the liquid inlet port. This differentiated design can adjust the ratio of the water to the foaming agent entering the mixing cavity. The inner diameter of the water inlet port or the inner diameter of the liquid inlet port can also be set to meet different needs.

5. In the foaming device of the present disclosure, the foaming cavity and the accelerating hole are defined in the self-suction spray head. The accelerating hole makes the foaming cavity generate a negative pressure zone, so that the first air inlet hole sucks in the air, and the mixed liquid is mixed with the air to produce the foam.

6. In the foaming device of the present disclosure, the self-suction spray head can adopt an integrated structure or a splittable structure, and a mesh can be arranged at the spray hole to make the foam that is produced more fine and uniform.

7. The toilet of the present disclosure comprises a mounting groove on the toilet body, and the foam is drained into the toilet bowl due to the inclined surface portion, and an odor-proof and splash-proof isolation layer is produced by floating of the foam on the water cover.

8. The foaming device of the present disclosure comprises the spray tube for draining the foam sprayed at the spray hole into the toilet bowl. The spray tube can also comprises a plurality of second air inlet holes for multiple inhalations to mix and produce a large amount of foam to further improve the foaming efficiency.

9. In the foaming device of the present disclosure, the spray tube comprises the first suction part and the second suction part to achieve multiple suctions, and the second suction part is inclined relative to the first suction part to play a role of diversion.

10. The toilet of the present disclosure can be equipped with a control valve to control supplying of the water and the foaming agent according to needs, such as starting supplying of the foaming agent and the water at the same time, or starting the supplying of the foaming agent first, and then the supplying of the water. The cycle or frequency of the foaming function can also be set according to needs.

In addition to being used in toilets, the foaming device of the present disclosure can also be used to cover an upper surface of trash bins or to cover up smelly gas generated in other places.

Figure 1:
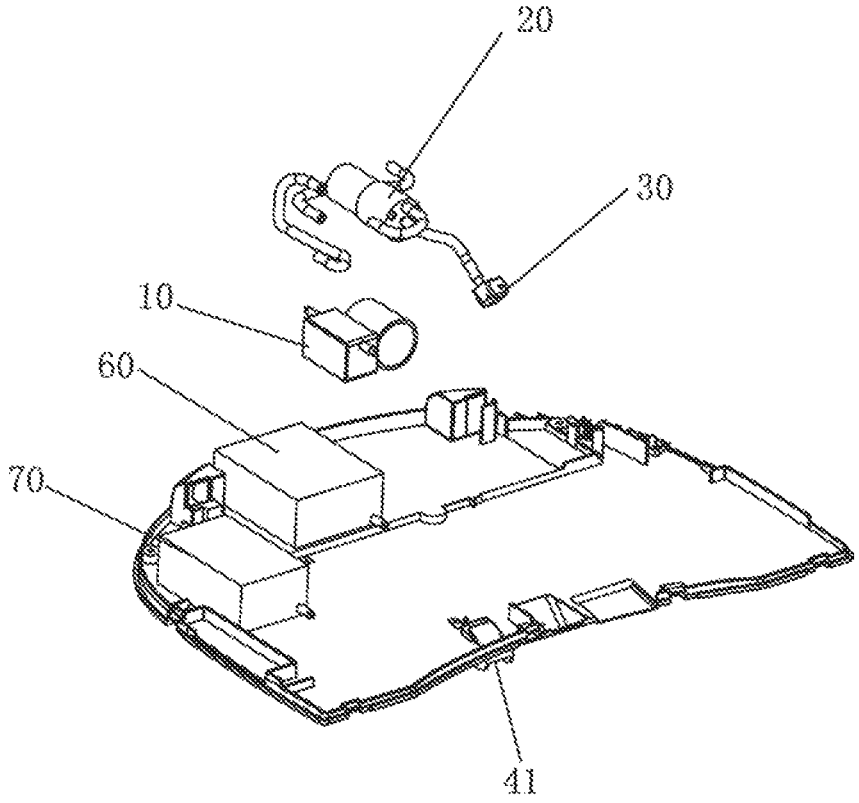
FIG. 1 illustrates an exploded view of a foaming device.

Wherein: 10 valve body, 11 water inlet port, 12 liquid inlet port, 13 mixing cavity, 14 liquid outlet port, 15 cavity, 16 partition, 20 pump, 30 self-suction spray head, 31 first air inlet hole, 32 spray hole, 33 foaming cavity, 34 accelerating hole, 35 self-suction head, 36 spray head, 37 buckle groove, 38 buckle strip, 40 toilet body, 41 mounting groove, 42 inclined surface portion, 50 spray tube, 51 spray port, 52 second air inlet hole, 53 first suction part, 54 second suction part, 55 mesh, 60 water tank, 70 agent tank.

DETAILED DESCRIPTION OF THE EMBODIMENTS

The present disclosure will be further described below in combination with the accompanying drawings and embodiments.

Embodiment 1

Referring to FIGS. 1 to 7, a foaming device comprises a valve body 10, and the valve body 10 comprises a water inlet port 11, a liquid inlet port 12, a mixing cavity 13, and a liquid outlet port 14. Each of the water inlet port 11, the liquid inlet port 12, and the liquid outlet port 14 is in communication with the mixing cavity 13. The foaming device further comprises a pump 20 and a self-suction spray head 30. An input end of the pump 20 is connected to the liquid outlet port 14 to enable the mixing cavity 13 to generate a negative pressure to suck water and foaming agent respectively from the water inlet port 11 and the liquid inlet port 12 for mixing. The self-suction spray head 30 is connected to an output end of the pump 20, and the self-suction spray head 30 comprises a first air inlet hole 31 and a spray hole 32 to enable mixed liquid to be mixed with air to produce foam to be sprayed out.

The mixing cavity 13 of the valve body 10 comprises at least two cavities 15 located therein, and the at least two cavities 15 are sequentially connected together to form a mixing channel, which has a wave shape, an S shape, or a Z shape. At least one partition 16 is disposed in the mixing cavity 13, and a gap is defined between a top of the at least one partition 16 and a corresponding side wall of the mixing cavity 13, a bottom of the at least one partition 16 and the corresponding side wall of the mixing cavity 13, a front side of the at least one partition 16 and the corresponding side wall of the mixing cavity 13, or a rear side of the at least one partition 16 and the corresponding side wall of the mixing cavity 13. The mixing cavity 13 is divided into the at least two cavities 15 by the at least one partition 16, and communication between two adjacent cavities 15 of the at least two cavities 15 is achieved by the gap between the at least one partition 16 and the corresponding side wall of the mixing cavity 13.

Figure 2:
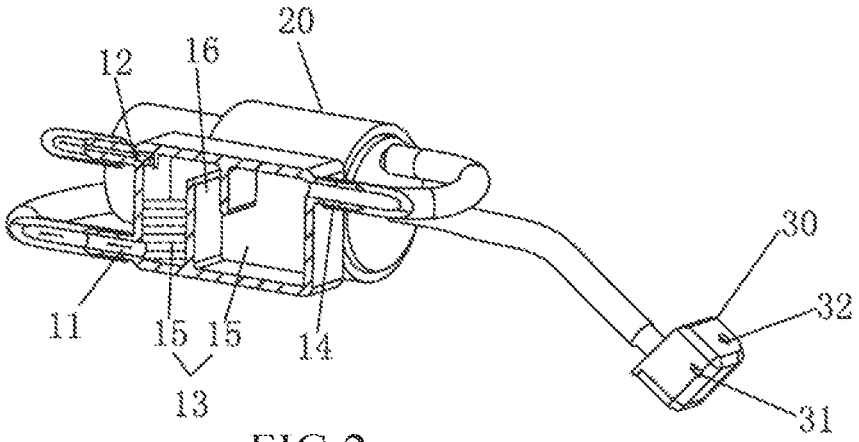
FIG. 2 illustrates a perspective view of a mixing cavity with half thereof removed, illustrating inside of the mixing cavity.
Figure 3:
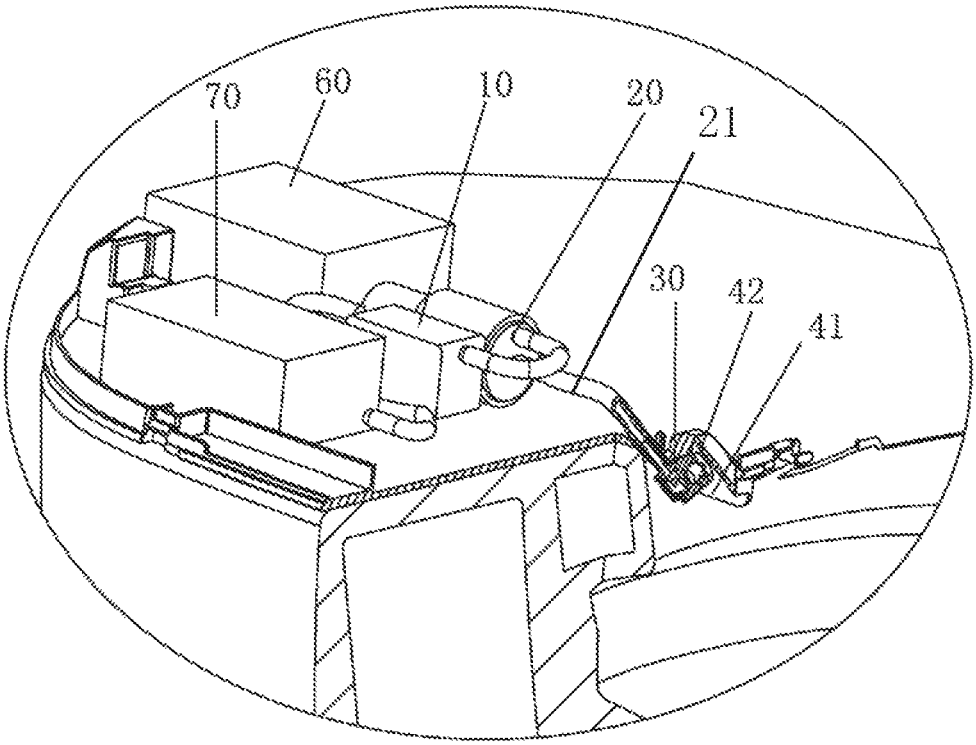
FIG. 3 illustrates a perspective view of the foaming device mounted on a foaming toilet.
Figure 4:
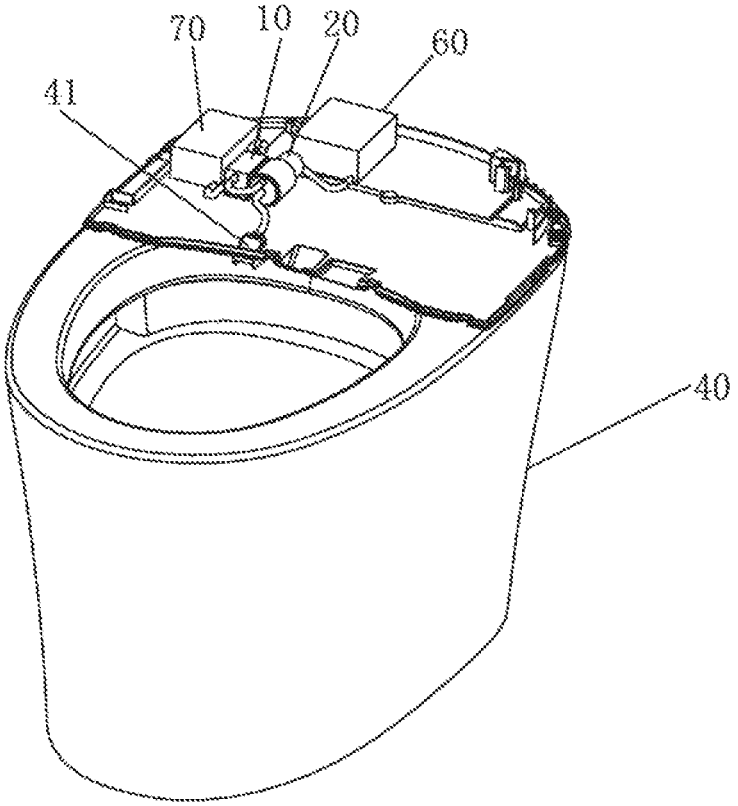
FIG. 4 illustrates a perspective view of the foaming toilet.
Figure 5:
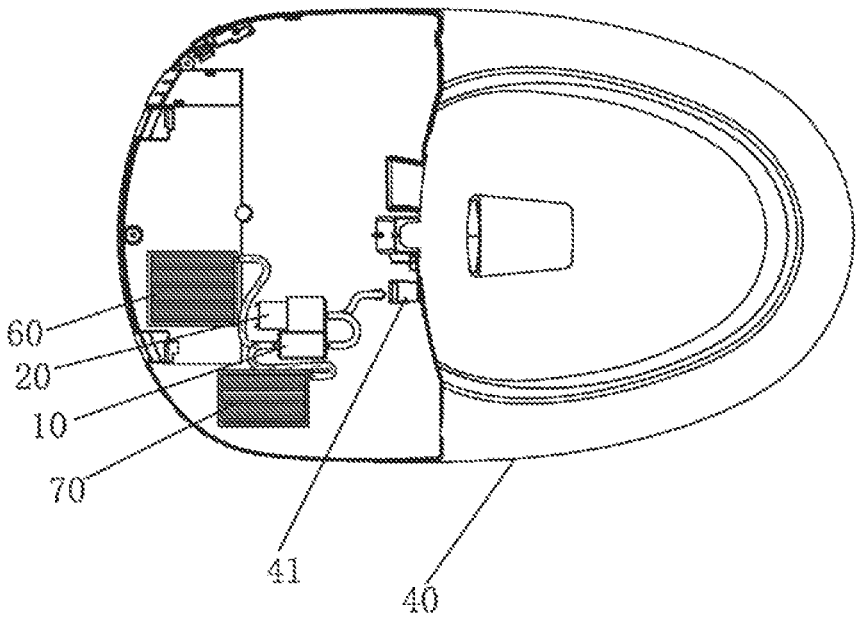
FIG. 5 illustrates a top view of the foaming toilet shown in FIG. 4.
Figure 6:
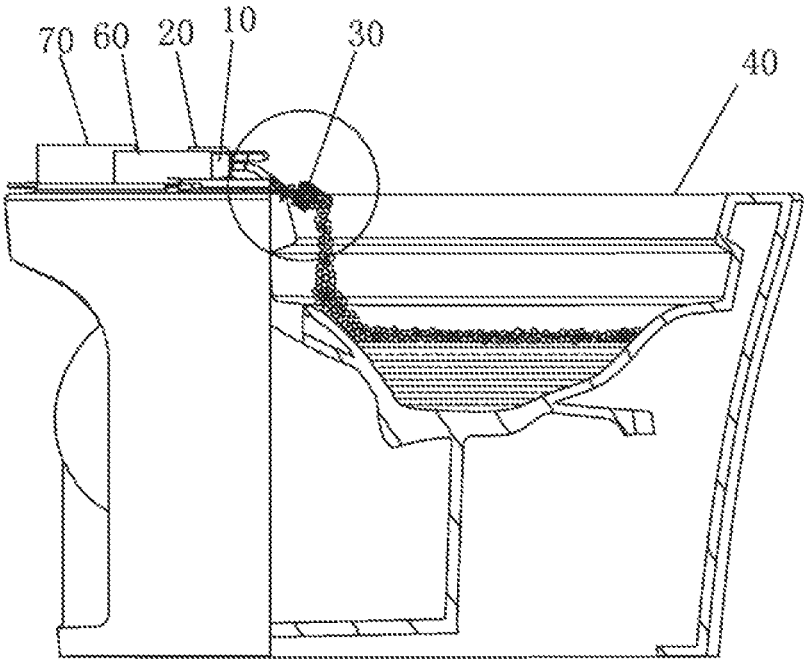
FIG. 6 illustrates a side view of the foaming toilet, illustrating a foaming process of the foaming device.
Figure 7:
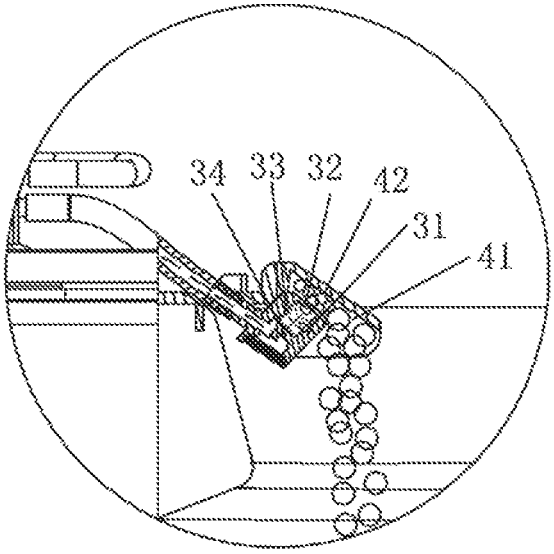
FIG. 7 illustrates an enlarged view of an encircled area in FIG. 6.

For example, referring to FIG. 2, the at least two cavities 15 are two cavities 15, and the at least one partition 16 is two partitions 16 disposed between the two cavities 15. A first one of the two cavities 15 is in communication with the water inlet port 11 and the liquid inlet port 12, and a second one of the two cavities 15 is in communication with the liquid outlet port 14. A first gap is defined between a top of a first one of the two partitions 16 and a top of the mixing cavity 13, and a second gap is defined between a second one of the two partitions 16 and a bottom of the mixing cavity 13.

An inner diameter of the water inlet port 11 is larger than an inner diameter of the liquid inlet port 12. Through differential design of the inner diameters of the water inlet port 11 and the liquid inlet port 12, a ratio of the water to the foaming agent flowing into the mixing cavity 13 is configured to be adjusted. The inner diameter of the water inlet port 11 or the inner diameter of the liquid inlet port 12 can also be adjusted to meet different needs.

The pump 20 of the present disclosure is configured to be a water pump, and the self-suction spray head 30 is connected to the output end of the pump 20 through a pipeline 21. The self-suction spray head 30 comprises a foaming cavity 33 and an accelerating hole 34, which are located therein. The foaming cavity 33 is in communication with each of the first air inlet hole 31 and the spray hole 32, and the accelerating hole 34 is in communication with each of the foaming cavity 33 and the output end of the pump 20.

An inner diameter of the accelerating hole 34 is smaller than an inner diameter of the pipeline so as to accelerate the mixed liquid and generate a negative pressure zone in the foaming cavity 33. The first air inlet hole 31 is adjacent to the accelerating hole 34 (i.e., located in the negative pressure zone), so as to achieve air inhalation. The form of the accelerating hole 34 is not limited to this arrangement, and the accelerating hole 34 can also be configured as a diameter reducing hole. A number of the accelerating holes 34 is one or more, and a number of the first air inlet holes 31 can also be one or more, so the disclosure is not limited to this regard.

The present disclosure also provides a foaming toilet, and the foaming toilet comprises a toilet body 40, a water tank 60, an agent tank 70, and the foaming device which has been mentioned. The water tank 60 is connected to the water inlet port 11, and the agent tank 70 is connected to the liquid inlet port 12. The water tank 60 may be an integrated water tank defined by the toilet body 40, or a separate water tank, which is configured to be set according to needs, and the disclosure is not limited to this regard. The agent tank 70 contains the foaming agent.

Further, the foaming toilet further comprises a mounting groove 41 arranged on the toilet body 40, and the mounting groove 41 comprises an inclined surface portion 42 inclined toward a toilet bowl. The self-suction spray head 30 is located in the mounting groove 41, and the spray hole 32 faces the inclined surface portion 42. The spray hole 32 sprays the foam outward, and the inclined surface portion 42 serves as a guide.

Specifically, the mounting groove 41 is located at a top edge of the toilet bowl, and the mounting groove 41 further comprises a through hole for the pipeline to pass through. In practical applications, the spray hole 32 can also face away from the inclined surface portion 42, and the spray hole 32 sprays directly toward the toilet bowl.

In the foaming device and the foaming toilet of the present disclosure, the water is injected into the water tank 60 in advance, and the foaming agent is filled into the agent tank 70. The working principle is as follows.

The pump 20 is controlled to start, the air in the mixing cavity 13 is drawn out to generate the negative pressure to suck the water and the foaming agent respectively through the water inlet port 11 and the liquid inlet port 12, and the water and the foaming agent are fully mixed with each other through the mixing channel to form the mixed liquid. The mixed liquid enters the pump 20 through the liquid outlet port 14, and the mixed liquid is output to the self-suction spray head 30 through the pipeline. The mixed liquid enters the foaming cavity 33 through the accelerating hole 34. In the foaming cavity 33, the air sucked in through the first air inlet hole 31 interacts with the mixed liquid to produce a large amount of foam. The foam is sprayed through the spray hole 32, the foam flows into the toilet bowl under an action of the inclined surface portion 42, and the foam floats on a water cover to produce an odor-proof and splash-proof isolation layer.

In practical applications, a control valve is configured to be set to control supplying of the water and the foaming agent according to needs. For example, the supplying of the foaming agent and the water is configured to be started at the same time, or the supplying of the foaming agent can be started first, and then the supplying of the water can be started. A cycle or frequency of a foaming function can also be set according to needs.

Embodiment 2

Figure 8:
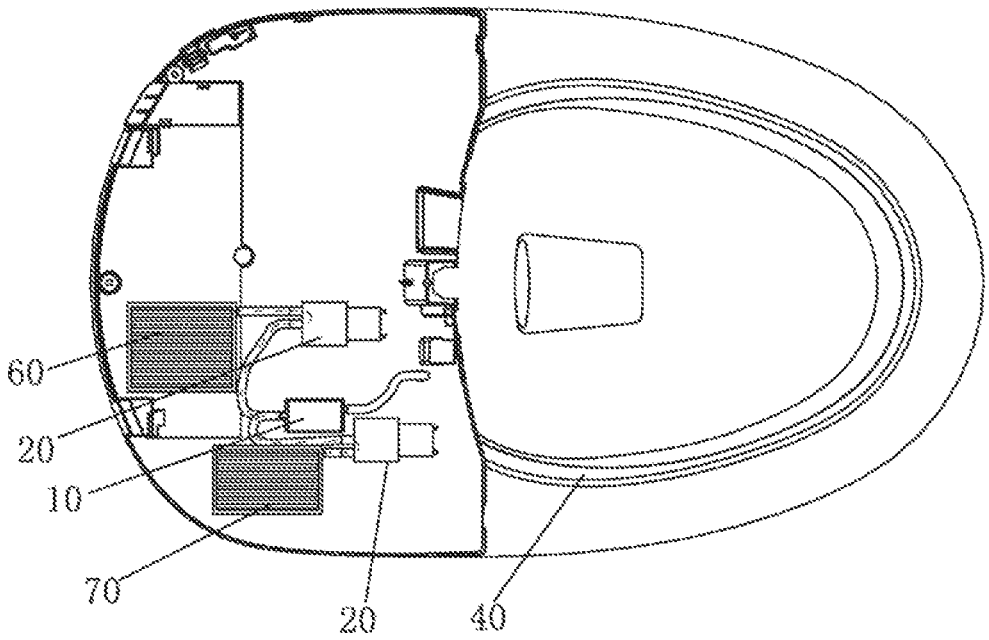
FIG. 8 illustrates a top view of a foaming device and a foaming toilet in Embodiment 2, illustrating a connection between the foaming device and the foaming toilet.
Figure 9:
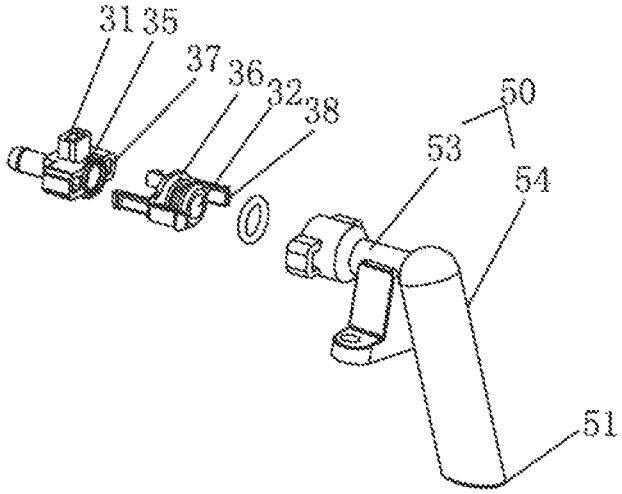
FIG. 9 illustrates a perspective exploded view of a spray tube and a self-suction spray head in Embodiment 3.
Figure 10:
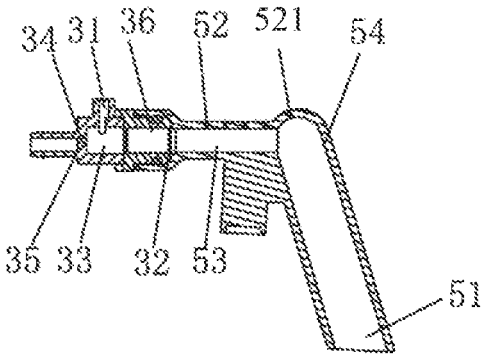
FIG. 10 illustrates a cross-sectional view of the spray tube and the self-suction spray head without a mesh in Embodiment 3.

Referring to FIG. 8, a foaming device and a foaming toilet are provided. A structure and a working principle of the foaming device are similar to that of Embodiment 1. The difference is that the foaming device comprises two pumps 20. A first one of the two pumps 20 is connected to the water inlet port 11 to suck water into the mixing cavity 13, and a second one of the two pumps 20 is connected to the liquid inlet port 12 to suck foaming agent into the mixing cavity 13. The self-suction spray head 30 is connected to the liquid outlet port 14 and comprises a first air inlet hole 31 and a spray hole 32 to enable mixed liquid to be mixed with the air to produce foam to be sprayed out.

The self-suction spray head 30 is connected to the liquid outlet port 14 through a pipeline. The self-suction spray head 30 comprises a foaming cavity 33 and an accelerating hole 34, the foaming cavity 33 is in communication with each of the first air inlet hole 31 and the spray hole 32, and the accelerating hole 34 is in communication with each of the foaming cavity 33 and the liquid outlet port 14.

In this embodiment, dual power is adopted to enable the supplying of the foaming agent and the water to be independently controlled, which can achieve precise quantitative and timing control output. The water tank 60 and the agent tank 70 are logically parallel, and the mixing cavity 13 is at a back end of the water tank 60 and the agent tank 70.

When this embodiment works, the foaming agent is controlled to be input into the mixing cavity 13 first, and then the water is input. After the first one of the two pumps 20 pumps the water into the mixing cavity 13, the following two actions can be performed: a. pumping of the water can be stopped after quantitative input or timing input; b. continuing to pump the water into the mixing cavity. If the water continues to be pumped into the mixing cavity 13, the water can push the mixed liquid out and reach the self-suction spray head 30 through the pipeline.

The mixed liquid enters the foaming cavity 33 under the action of the accelerating hole 34. In the foaming cavity 33, the air sucked in through the first air inlet hole 31 interacts with the mixed liquid to produce a large amount of foam, which is sprayed out through the spray hole 32. Under the action of the inclined surface portion 42, the foam flows into the toilet bowl and floats on a water cover to produce an odor-proof and splash-proof isolation layer.

While the water is continuously pumped into the mixing cavity 13, the foaming agent can be simultaneously input. A new water and foaming agent mixture is formed at a predetermined time/quantity to achieve continuous foaming. In this embodiment, the method is not limited to using a water pump to control the input, and other methods (pipe pressure) to output the liquid in the water tank 60 that can also achieve the effect of the solution of this embodiment can be used.

Embodiment 3

Referring to FIG. 9, FIG. 10, FIG. 12, and FIG. 13, a foaming device and foaming toilet are provided. The structure is similar to Embodiment 1, the difference is: the self-suction spray head 30 adopts a splittable structure, which can comprise a self-suction head 35 and a spray head 36. The self-suction head 35 comprises a first air inlet hole 31 and an accelerating hole 34, and the spray head 36 is in communication with the self-suction head 35 and comprises a spray hole 32.

The foaming device further comprises a spray tube 50. A first end of the spray tube 50 is in communication with the self-suction spray head 30, and a second end of the spray tube 50 comprises a spray port 51. The spray tube 50 may comprise a second air inlet hole 52 or may not comprise the second air inlet hole 52, which can be set as required. The first end of the spray tube 50 is sleeved on a side on which the spray hole 32 of the spray head 36 is located, and a connection between the spray tube 50 and the spray head 36 is sealed by a sealing ring.

For example, the spray tube 50 comprises a plurality of second air inlet holes 52. The spray tube 50 comprises a first suction part 53 and a second suction part 54. A first end of the first suction part 53 is connected to the self-suction spray head 30 and comprises the plurality of second air inlet holes 52, and the second suction part 54 is arranged obliquely at a second end of the first suction part 53 and comprises a third air inlet hole 521. The second suction part 54 also has a function of flow guiding.

The plurality of second air inlet holes 52 on the first suction part 53 may be evenly distributed along an axial direction of the first suction part 53, and the number of the plurality of second air inlet holes 52 is not limited. The third air inlet hole 521 on the second suction part 54 is located on an end of an inner wall of the second suction part 54 adjacent to the first suction part 53. An inner diameter of the first suction part 53 may be smaller than an inner diameter of the second suction part 54. An included angle is formed between the first suction part 53 and the second suction part 54, and the included angle may be an obtuse angle or a right angle, which is set as required and is not limited.

In this embodiment, between the self-suction head 35 and the spray head 36, and between the spray head 36 and the spray tube 50, a detachable connection can be adopted, including threaded fitting or snap fitting. For snap fitting, the self-suction head 35 and the spray tube 50 comprise buckle grooves 37, and the spray head 36 comprises buckle strips 38. The buckle strips 38 are buckled into the buckle grooves 37 to achieve fixation.

In practical applications, a bracket is provided on the toilet body 40 to install the spray tube 50. The specific foaming principle is as follows.

The pump 20 is controlled to start, the air in the mixing cavity 13 is drawn out to generate the negative pressure to enable the water and the foaming agent to be sucked in through the water inlet port 11 and the liquid inlet port 12 respectively, and the water and the foaming agent are fully mixed with each other through the mixing channel to form the mixed liquid. The mixed liquid enters the pump 20 through the liquid outlet port 14. The mixed liquid is output to the self-suction spray head 30 through the pipeline, and the mixed liquid enters the foaming cavity 33 through the accelerating hole 34. In the foaming cavity 33, the air sucked in through the first air inlet hole 31 interacts with the mixed liquid to produce a large amount of foam. The foam is sprayed toward the spray tube 50 through the spray hole 32. When the foam is located in the first suction part 53, the plurality of second air inlet holes 52 inhale, and a second air mixing is performed to make the foam larger. The foam enters the second suction part 54, the foam hits the inner wall of the second suction part 54 to roll over, the third air inlet hole 521 on the second suction part 54 inhales, and a third air mixing makes the foam larger. Finally, the foam is sprayed into the toilet bowl through the spray port 51 and floats on the water cover to produce an odor-proof and splash-proof isolation layer.

Embodiment 4

Figure 11:
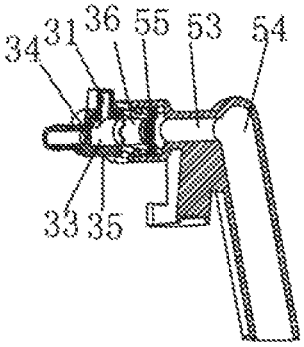
FIG. 11 illustrates a cross-sectional view of a spray tube and a self-suction spray head with a mesh in Embodiment 4.
Figure 12:
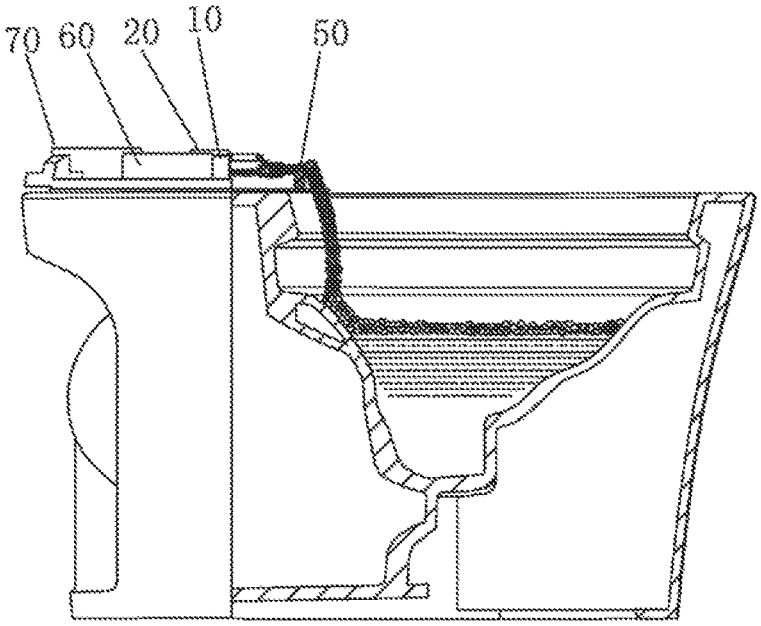
FIG. 12 illustrates a side view of the foaming toilet in Embodiment 3, illustrating a foaming process of the foaming device.
Figure 13:
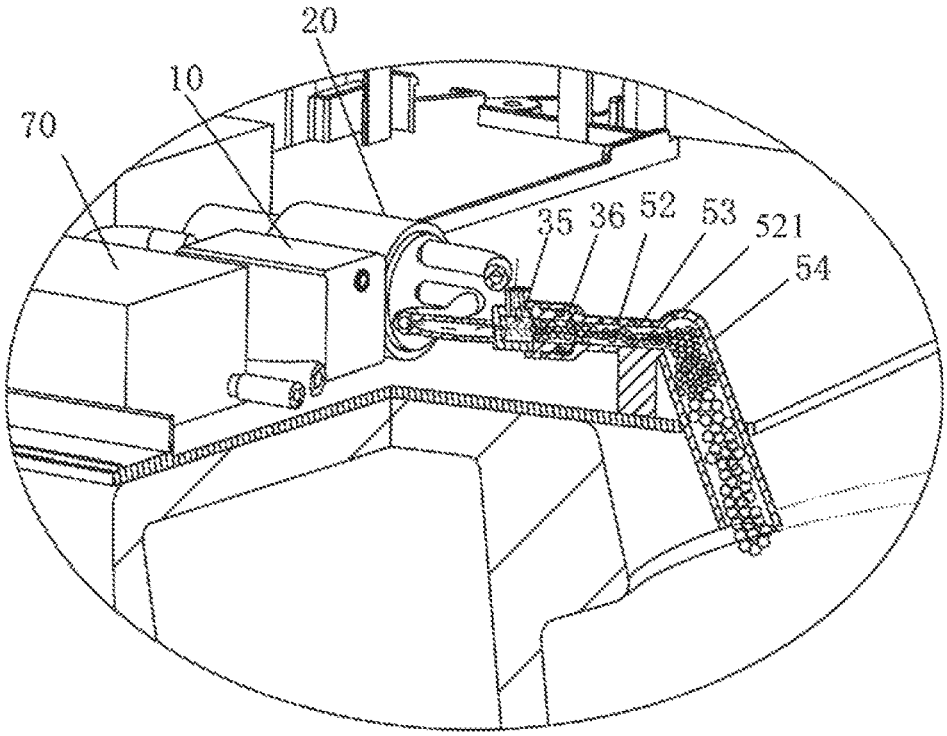
FIG. 13 illustrates an enlarged perspective view of the foaming toilet in Embodiment 3.

Referring to FIG. 11, a foaming device and a foaming toilet are provided, a structure of which is similar to that of Embodiment 1. The difference is that: a mesh 55 is also disposed at the spray hole 32 of the self-suction spray head 30, so that the foam is finer and even.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A foaming device, comprising:

a valve body, a pump, and a self-suction spray head, wherein:

the valve body comprises a water inlet port, a liquid inlet port, a mixing cavity, and a liquid outlet port, each of the water inlet port, the liquid inlet port, and the liquid outlet port is in communication with the mixing cavity, an input end of the pump is connected to the liquid outlet port to enable the mixing cavity to generate a negative pressure to suck water and foaming agent respectively from the water inlet port and the liquid inlet port for mixing to form mixed liquid, the self-suction spray head is connected to an output end of the pump, and the self-suction spray head comprises a first air inlet hole and a spray hole to enable the mixed liquid to be mixed with air to produce foam to be sprayed out.

2. The foaming device according to claim 1, wherein:

an inner diameter of the water inlet port is larger than an inner diameter of the liquid inlet port.

3. A foaming device, comprising:

a valve body, two pumps, and a self-suction spray head, wherein:

the valve body comprises a water inlet port, a liquid inlet port, a mixing cavity, and a liquid outlet port, each of the water inlet port, the liquid inlet port, and the liquid outlet port is in communication with the mixing cavity, a first one of the two pumps is connected to the water inlet port to suck water into the mixing cavity, a second one of the two pumps is connected to the liquid inlet port to suck foaming agent into the mixing cavity, and the self-suction spray head is connected to the liquid outlet port and comprises a first air inlet hole and a spray hole to enable mixed liquid to be mixed with air to produce foam to be sprayed out.

4. The foaming device according to claim 3, wherein:

the mixing cavity comprises at least two cavities located therein, and the at least two cavities are sequentially connected together to form a mixing channel.

5. The foaming device according to claim 3, wherein:

at least one partition is disposed in the mixing cavity, and a gap is defined between a top, a bottom, a front side, or a rear side of the at least one partition and a corresponding side wall of the mixing cavity.

6. The foaming device according to claim 3, wherein:

the self-suction spray head comprises a foaming cavity and an accelerating hole, the foaming cavity is in communication with each of the first air inlet hole and the spray hole, and the accelerating hole is in communication with the foaming cavity.

7. The foaming device according to claim 3, wherein:

the self-suction spray head comprises a self-suction head and a spray head, the self-suction head comprises the first air inlet hole, and the spray head is in communication with the self-suction head and comprises the spray hole.

8. The foaming device according to claim 3, wherein:

a mesh is disposed at the spray hole.

9. The foaming device according to claim 3, wherein:

the foaming device further comprises a spray tube, a first end of the spray tube is in communication with the self-suction spray head, and a second end of the spray tube comprises a spray port.

10. The foaming device according to claim 9, wherein:

the spray tube comprises a first suction part and a second suction part, a first end of the first suction part is connected to the self-suction spray head and comprises a plurality of second air inlet holes, and the second suction part is arranged obliquely at a second end of the first suction part and comprises a third air inlet hole.

11. A foaming toilet, comprising:

a toilet body, a water tank, and an agent tank, wherein:

the foaming toilet further comprises the foaming device according to claim 3, the water tank is connected to the water inlet port, and the agent tank is connected to the liquid inlet port.

12. The foaming toilet according to claim 11, wherein:

the foaming toilet further comprises a mounting groove arranged on the toilet body and comprising an inclined surface portion inclined toward a toilet bowl, and the self-suction spray head is located in the mounting groove and the spray hole faces or faces away the inclined surface portion.

13. A foaming device, comprising:

a mixing cavity, a pump, and a self-suction spray head, wherein:

the mixing cavity is in communication with each of a water inlet port, a liquid inlet port, and a liquid outlet port, the water inlet port is configured to be connected to a water tank, the liquid inlet port is configured to be connected to an agent tank, an input end of the pump is connected to the liquid outlet port to enable the mixing cavity to generate a negative pressure to suck water and foaming agent respectively from the water inlet port and the liquid inlet port for mixing to form mixed liquid, the self-suction spray head is connected to an output end of the pump, and the self-suction spray head comprises a first air inlet hole and a spray hole to enable the mixed liquid to be mixed with air to produce foam to be sprayed out.

14. The foaming device according to claim 13, wherein:

the mixing cavity comprises at least two cavities located therein, and the at least two cavities are sequentially connected together to form a mixing channel.

15. The foaming device according to claim 13, wherein:

an inner diameter of the water inlet port is larger than an inner diameter of the liquid inlet port.

16. The foaming device according to claim 13, wherein:

the self-suction spray head comprises a foaming cavity and an accelerating hole, the foaming cavity is in communication with each of the first air inlet hole and the spray hole, and the accelerating hole is in communication with the foaming cavity.

17. The foaming device according to claim 13, wherein:

a mesh is disposed at the spray hole.

18. The foaming device according to claim 13, wherein:

the foaming device further comprises a spray tube, a first end of the spray tube is in communication with the self-suction spray head, and a second end of the spray tube comprises a spray port.

19. The foaming device according to claim 18, wherein:

the spray tube comprises a first suction part and a second suction part, a first end of the first suction part is connected to the self-suction spray head and comprises a plurality of second air inlet holes, and the second suction part is arranged obliquely at a second end of the first suction part and comprises a second air inlet hole.

20. The foaming device according to claim 13, wherein:
the foaming device is configured for a toilet.

* * * * *